United States Patent [19]

Anton et al.

[11] 3,995,729

[45] Dec. 7, 1976

[54] IMPACTLESS PRINTING APPARATUS

[75] Inventors: Wolfgang Rainer Anton; Ernst Reinhold Gebhardt, both of Nurnberg, Germany

[73] Assignee: Triumph Werke Nurnberg A.G., Nurnberg, Germany

[22] Filed: Dec. 19, 1975

[21] Appl. No.: 642,295

Related U.S. Application Data

[63] Continuation-in-part of Ser. No. 493,205, July 31, 1974, abandoned.

[30] Foreign Application Priority Data

Aug. 7, 1973 Germany ..... 2339852
Dec. 21, 1974 Germany ..... 2461016

[52] U.S. Cl. ..... 197/1 R; 101/1; 101/426; 101/DIG. 13; 197/172; 346/1

[51] Int. Cl.[2] ..... B41J 31/05; B41J 3/00

[58] Field of Search ..... 197/1 R, 172; 346/76 R, 346/139 C, 74 J, 74 R, 1, 74 ES; 101/114, 1, DIG. 13, 426

[56] References Cited

UNITED STATES PATENTS

| | | | |
|---|---|---|---|
| 3,389,398 | 6/1968 | Engstrom et al. | 101/1 |
| 3,550,153 | 12/1970 | Haeberle et al. | 346/74 |
| 3,719,261 | 3/1973 | Heinzer et al. | 346/76 R X |
| 3,744,611 | 7/1973 | Montanari et al. | 346/76 R X |
| 3,824,924 | 7/1974 | Rarey et al. | 101/114 |
| 3,847,265 | 11/1974 | Ehretsmann | 197/172 |
| 3,857,470 | 12/1974 | Bastard | 197/1 R |

*Primary Examiner*—Edgar S. Burr
*Assistant Examiner*—R. E. Suter
*Attorney, Agent, or Firm*—Joseph R. Spalla

[57] ABSTRACT

Disclosed herein is a thermoelectric printing method and apparatus pertaining to the technology which avoids the mechanical impact of printing elements upon an ink ribbon, as used in office machines or the like. In accordance with the method, an electrically insulating support of substantially two-dimensional perforated sheet material having two major surfaces, preferably glass fiber or nylon mesh material, is impregnated, in accordance with one embodiment, with electrically conductive printing ink, and, in accordance with another embodiment, with conductive ink in the form of pigment particles suspended in a dielectric binder. Then, by applying potential gradients or character signals across electrodes, sandwiching the support, one of which is permeable, ink is caused to transfer through the permeable electrode to paper or other recording material located outside the sandwich adjacent the permeable electrode.

8 Claims, 4 Drawing Figures

IMPACTLESS PRINTING APPARATUS

This application is a continuation-in-part of copending U.S. Pat. application Ser. No. 493,205, filed July, 31, 1974, now abandoned.

This invention relates to non-mechanical printing methods and assemblies of the type useful for office machines and the like where no movable element is provided which would strike an ink support, usually a ribbon supporting the ink. This class of recently developed impactless technology is conveniently and descriptively referred to by the designations thermoelectric printing methods and thermoelectric printing apparatus.

The technology referred to herein as thermoelectric printing is related to that frequently called "electrostatic printing". An example of electrostatic printing is given by German Published Application (DOS) No. 2,257,150 which describes a process and apparatus for printing impactlessly with liquid ink, by using an electrically conductive ribbon and electrical means for producing a pattern on paper or the like, due to the selective attraction of ink. In accordance with this development, the ink carrier contains an electrically conductive ink in a multiplicity of capillar perforations which extend through the carrier and in which the ink is retained by capillary action. Accordingly, this process and its associated equipment basically involves electrostatic printing. As stated in the above-mentioned German Published Application (DOS), this technology is developed further so that various limitations inherent in other known processes and apparatus are overcome, particularly those with respect to controlling the selective ink transfer at high speeds and the preclusion of uncontrolled ink transfer and the attainment of gradual changes in shading, to produce slight differences of tones in the pattern produced.

A similar process is described in the French Pat. No. 1,575,106 in which the control of ink transfer and gradual changes between light and dark are accomplished by causing the electron beam of a picture tube to electrically charge ink particles which are then selectively attracted for reproduction of a corresponding color pattern on paper or the like. The arrangement is such that the use of the conductive ink pigment particles, such as carbon or the like, can be omitted, thus making it possible to work with ordinary printing ink or dye. The ink carrier in the above-mentioned French patent consists of a grid insulating material and impregnated with such dye or ink.

Referring to a further prior art publication, according to French Pat. No. 1,603,927, electrons are set free in an electronic printing process utilizing the tunnel effect. These electrons are caused to charge ink which is contained in juxtaposed capillary perforations in such a manner that the ink is accelerated by means of electrical fields set up adjacent the capillary perforations, to thereby perform ink transfer on a point-by-point basis.

These processes and equipment for printing electrostatically, particularly with respect to higher printing speeds, are of relatively complicated nature, and, for this reason, they are not only expensive to produce but are also relatively unreliable. Consequently, processes and apparatus have become known which likewise work impactlessly, i.e. non-mechanically, but are more descriptively designated electrothermal printing processes. Such a process is described in German Published Application (DOS) No. 2,100,611, for example.

It discloses an electrothermal writing device in which an ink layer, to be transferred by heat, is applied to a surface capable of accepting the ink in those areas where the ink was softened by means of a heat source, a film of electrically conductive material being applied over the ink layer, and a multiplicity of electrodes or the like being provided to which a voltage can be applied selectively. The electrodes are brought into contact with the film of electrically conductive material in such a manner that a correspondingly limited portion of the electrically conductive material is series-connected electrically with each one of the electrodes, so that the current flowing through each electrode generates, in a correspondingly limited area of the electrically conductive film, a quantity of Joule heat which passes into the ink to be thermally transferred, to thereby soften it locally, i.e. selectively. The arrangement is such that the applied film of electrically conductive material contains a layer of low electrical resistance to which the layer of ink to be thermally transferred is applied, thereby forming a ribbon of layered structure. Furthermore, the electrically conductive material is preferably disposed on an insulating substrate and comprises a varnish which contains conductive ingredients. According to other characteristics of this known apparatus, each one of the mentioned electrodes contains a central writing pin and a peripheral section surrounding the center pin and common to all writing electrodes.

The above-described electrothermal printing process and the electrostatic processes described above have in common that they permit operating with conventional recording material, i.e. recording material not specially prepared for the purpose for which it is intended. However, while it is generally very difficult or altogether impossible for apparatus based on the thermostatic principle to meet the requirements for their use, say, in regular typewriters or similar machines, there are limits to the printing speed, i.e. to increasing the printing speed, of the apparatus based on the electrothermal principle, due to the laws of physics controlling heat conduction and heat transfer.

It is, therefore, one of the main objects of the invention to provide methods and apparatus for printing impactlessly, i.e. non-mechanically, thus improving thermoelectric printing technology using electrically conductive ink, by avoiding the aforementioned disadvantages and limitations completely or at least to a large extent.

Specific objects of the invention include the provision of methods and apparatus which meet the requirements which must be met for their use in connection with typewriters, input/output printing units, office machines, teleprinters or the like, namely simple design, low production costs, easy and inexpensive maintenance and so forth.

The present invention is based on the recognition that an improved printing technology could be achieved, particularly with respect to the ink transfer speed, if the use of elements performing the function of heating units in known arrangements could be avoided and that this could be done by sending currents directly through the ink, instead of through such heating units. Then, the heat generated as a result of dissipated power would soften the ink locally at those locations where marking is intended. This would occur under optimum speed condutions, because a minimum quantity of material would have to be heated. In somewhat different terms, with all other parameters maintained constant, only the heat capacity of the ink to be softened would play a role in establishing the speed with which the local heating would occur.

Thus, in accordance with a broad aspect of the invention, the printing technology in accordance with the present invention involves the provision of an electrically insulating support of substantially two-dimensional perforated sheet material having two major surfaces, such as fiber glass mesh material, which will be impregnated with electrically conductive printing ink. Then, ink is caused to locally soften in selected areas of the support by means of electrical currents flowing from one surface location through the ink to a corresponding location at the other surface of the ink-impregnated perforated sheet material. The ink thus softened is transferred onto recording material, such as ordinary paper.

In a practical embodiment, use is made of two electrodes, of which the first electrode is an assembly of a plurality of wire conductors or the like, to which character signals are applied. This writing electrode is provided at one side of the ink-impregnated perforated sheet material. The other electrode, performing the function of a counterelectrode, preferably maintained at ground potential, takes the form of a perforated structure, such as a grid or mesh material, so that softened ink will pass through the openings and apply it to paper or other recording material, so that the descriptive designation "transfer electrode" may conveniently be used.

Thus, in accordance with an illustrative embodiment of the invention, there is provided a device for printing impactlessly or non-mechanically with electrically conductive ink. According to this embodiment of the invention, an electrically conductive, in practice, metallic grid or the like constitutes the transfer electrode which, during operation, is located opposite and adjacent a sheet of recording material such as paper or the like. Adjacent the other side of the perforated transfer electrode is a grid-like carrier of insulating mesh material for supporting an electrically conductive ink. Since the fine openings in the carrier of insulating material absorb the electrically conductive ink, the arrangement may properly be described as an impregnation. At least one, preferably a plurality of writing, or marking, electrodes are located adjacent the free side of the ink-impregnated support of insulating mesh material. Generally, the marking electrodes form an assembly which is mounted such that it can, during operation, press the ink-impregnated support against the electrically conductive, preferably grounded, grid, i.e. the transfer electrode, to thereby establish electrical contact between the marking electrode assembly and electrically conductive ink, on the one hand, and ink and the transfer electrode, on the other hand. Thereby is formed a current path between the two electrodes, and therefore, through the expanse of conductive ink formed by the impregnated, substantially two-dimensional support. In this manner, the ink support and the grid-like transfer electrode are pressed against the recording material simultaneously, as needed.

In practice, a printing assembly in accordance with the invention will be operated with an electrically conductive ink having the properties of a so-called thermo-ink, viz. an ink which can be softened, for instance under the action of Joule's heat, within a certain temperature range, so that there can be a transfer of the softened or liquid ink onto the recording material. It was found that good results were obtained with an operating voltage of approximately 6 to 40 V, applied between the grounded metallic grid or mesh material, constituting the transfer electrode and the marking electrode. Suitably, the marking electrode is an assembly of a plurality of selectively energizable wire electrodes in a common insulating support for the formation of a desired pattern of individual point marks on the recording material, which pattern may have the configuration of an alphanumerical character or a portion thereby.

In accordance with another embodiment of the invention, the apparatus is operated with an electrically conductive ink composed of electrically conductive pigment particles, such as graphite, suspended an insulating (dielectric) binder. Then, multiple electrical discharges or dielectric breakdowns will occur between the various pigment particles with the result that conductive pigment particles are propelled to record material. Particularly advantageous operating conditions are obtained if a voltage of at least 100 V is applied between the grounded transfer electrode and the marking electrode when using this type of ink.

The invention will become better understood from the following detailed description of one embodiment thereof, when taken in conjunction with the drawings, wherein:

FIG. 1 is a schematic, simplified sectional view of the various components of a printing apparatus in accordance with the invention and of their operative association;

FIG. 2 similarly illustrates, on a larger scale, the various components of the printing apparatus of FIG. 1 and their operative association when used with electrically conductive pigment particles suspended in a binder, wherein the right-hand side of FIG. 2 schematically illustrates conditions prior to the application of a marking voltage and the left-hand side of FIG. 2 illustrates the conditions with an applied voltage;

Figure 2:
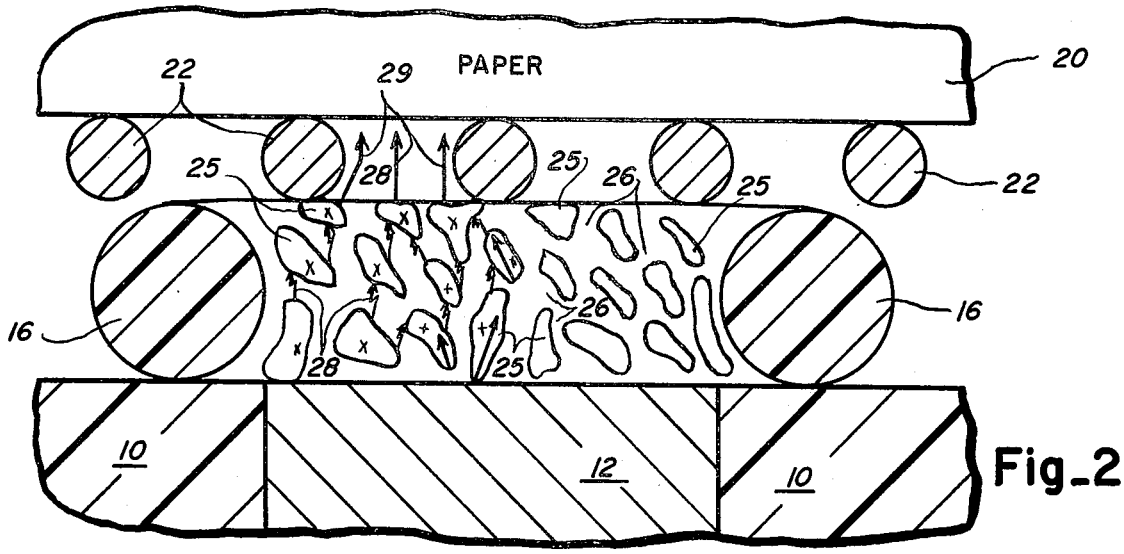
Figure 5:
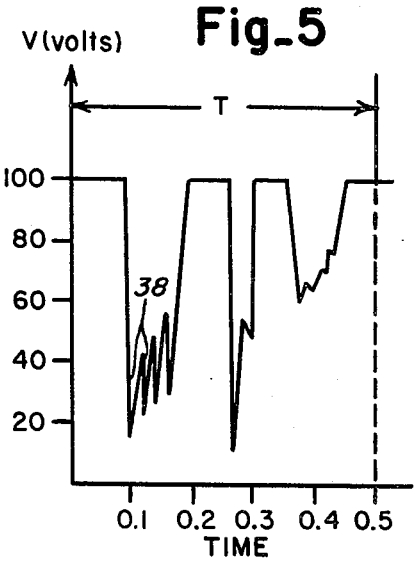

FIG. 5 schematically illustrates an oscillogram of the voltage waveform over a writing interval resulting from the conditions shown in the left-hand side of FIG. 2.

Figure 1:
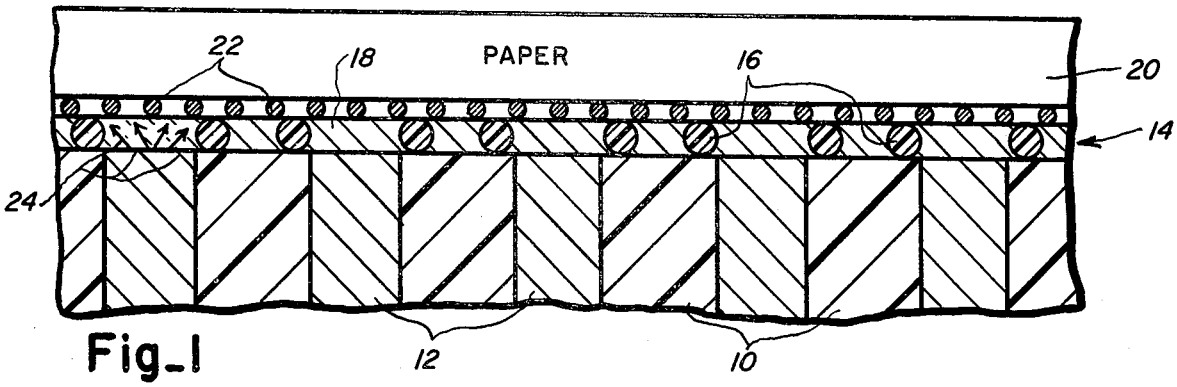

With reference to FIG. 1, the essential components of the illustrated printing assembly are a marking electrode assembly comprising an insulating supporting body 10, preferably made of an insulating plastic, glass, enamel, ceramic or the like, having embedded therein at least one electrode, generally a plurality of electrodes in the form of fine wires 12, functioning as printing or writing electrodes when an operating or energizing voltage V is applied to them. Each such electrode may be a length of wire of a good electrical conductor and measure 0.1 mm in diameter and is preferably an erosion-proof conductor such as tungsten.

Adjacent the free front faces of these embedded electrode wires 12 is mounted a preferably ribbon-shaped ink support 14, made of very fine mesh or net material, such as nylon or fiberglass, with fibers 16 of 0.04 mm thickness. The electrically conductive ink 18 is retained in the perforations, i.e. meshes, of the support 14, thus being impregnated with ink.

The composition and properties of the conductive ink 18 are apparent when considering that the ink contains graphite powder or NiCr or other finely divided resistance material and, to improve the contact-making ability of its surface, it may also have a content of silver powder. The specific resistance of this special ink may be between 10 and 500 Ohms/cm. The body of the ink may be of a type corresponding approximately to that used on known thermocopying papers or also on thermoribbons. Its melting temperature may range between approximately 80° and about 150° C, below which it remains noncoloring when in contact with paper or the like, whereas it becomes liquid above this temperature and adheres to paper. The conductive ink 18 should have the property of enabling ordinary paper to absorb it, in order to promote in this manner the process of transferring it from the typehead, such as the marking electrode assembly 12 through the ink-impregnated support 14 to paper 20 or other recording material of about 0.1 mm thickness.

Due to the fact that the insulating support of fiber mesh material 16 for the conductive ink 18 is very thin, i.e. a substantially two-dimensional structure providing such expanse of ink, and makes direct contact with the electrodes 12 of the marking electrode assembly, a substantial improvement over the hitherto known arrangements is achieved because the heat generation occurs directly within the ink 18 itself, thus without being firstly absorbed or conducted through heat-insulating intermediary layers. Since currents flow between the marking electrode, or electrodes, 12 of the matrix formed by the electrodes 12 in their plastic support 10 and a counterelectrode, namely a suitably grounded transfer electrode 22 having the form of a perforated conductive structure, such as a grid, wire mesh or the like, the ink 18 itself constitutes a resistance element, as it develops Joule heat within the meshes of its support 16, due to the current flow indicated by arrows 24 between the electrodes 12 and the transfer electrode 22. The heat, thus generated, results in the locally occurring softening of the electrically conductive ink 18 selectively in those areas which are adjacent selected, i.e. energized wire, electrodes 12. Consequently, ink 18 present in one or more meshes of the supporting mesh material 16 will cause a transfer of ink to form marks on the paper 20, brought about by the contact between the paper 20 and the free surface of the transfer electrode 22, as the result of pressure applied to the marking electrode assembly 10, 12 which thus is seen to bring the various elements into the illustrated relative positions of engagement with an adjacent element.

The conductive ink support 14 thus forms a ribbon capable of regeneration. Thus, it may comprise fiberglass fabric as the mesh material of which the ribbon is made. Suitably, it is very thin and heat-resistant. In conjunction with, for example, an office machine, it is mounted such that it can move in front of the marking electrodes 12 which are preferably arranged to form a matrix. Inking rollers or the like, known per se and not shown, may be used for replenishing conductive ink 18, as it is used up, due to its transfer from the support mesh material 16. Adjacent to this regenerable ink-impregnated support 14, which may be a ribbon, is the movably disposed transfer electrode 22, which may be a fine, electrically conductive, metallic grid or equivalent perforated structure, for example, a metal wire cloth of steel or bronze. Advantageously, a very thin perforated nickel sheet may be used. The dimensions of the grid pattern may, but need not, match the dimensions of the pattern of the marking electrode matrix 12. This grid pattern, i.e. the arrangement of perforations, in transfer electrode 22 is dimensioned such that a wire electrode 12 of the matrix is located symetrically, or centrally, behind one or more associated mesh openings in transfer electrode 22.

In its rest position, the metallic grid or mesh structure of the transfer electrode 22 stands slightly away from the ink-impregnated support 14, so that the support 14 is freely movable for regeneration. For purposes of printing, to assume its working position, the transfer electrode 22 is urged against the ink-impregnated support 14 and the matrix of electrodes 12, so that the advancing motion of the ink-impregnated support 14 is stopped for the duration of the actual printing step.

When a voltage V, in practice a character signal, is applied to a wire electrode 12, current illustrated by arrows 24 flows through the conductive ink 18, which is thereby heated, softened, and, as it is then in liquid form, absorbed by the paper 20. This effect is partly due to thermal expansion of the ink and partly due to the paper unevennesses penetrating into the openings of the perforated transfer electrode 22. Upon transfer, the ink solidifies on the paper 20. In this process, it is immaterial how uniform the contact between an electrode 12 and the expanse of ink, i.e. structure 14 and paper 20, may be. This is so because, if the current flows at first only in a small, partial area of the front face of electrode 12, the softened, thus liquid, ink will spread from this area and thus establish electrical contact and a wider current path in the other areas of the front face of electrode 12. Even in the case of relatively high resistance at a specific energized location, the heating effect is obtained in the apparatus according to the invention due to breakdown, so that good contact with the partly liquified ink 18 is thus established.

It is advantageous to operate the arrangement thus far described using the electrically conductive ink mentioned above at a voltage V of between 6 volts and about 40 volts.

In accordance with a particularly advantageous modification of the invention, as illustrated in FIG. 2, the same arrangement of an insulating ink support between two electrodes can also be operated with an ink in which electrically conductive pigment particles, such as graphite, carbon black or soot and/or metal particles 25, are mixed together with a binder of dielectric material, e.g. stearin, together with a solvent and applied to the support 14. After the solvent evaporates, the particles of pigment are suspended in the binder 26 in such a manner that multiple electrical breakdown of the binder 26, illustrated by arrows 28 in FIG. 2, occurs between the various pigment particles 25, to thereby soften or vaporize the binder 26 forming binder bridges prior to energization, as shown in the right-hand side of FIG. 2. The vaporization and/or the transition toward the liquid state of the binder imparts to the electrically charged pigment particles 25 a mobility enabling them to be accelerated, under the influence of the established electric field, so that they are propelled with surrounding binder 26, as indicated by arrows 29, out of the meshes between the fibers 16 of the ink-impregnated support, through the openings, i.e. perforations, in the transfer electrode 22 and onto the paper 22. A suitable operating voltage of at least 100 V which is a multiple of the breakdown voltage of the dielectric binder 26 is provided to produce the multiple breakdown effect, thus described, and constituting a particularly advantageous feature of the invention. The duration and energy of the breakdowns or spark overs is controlled in such a manner as to render the dielectric following each breakdown capable of permitting movement of the conductive particles under the influence of the electric field buildup.

Figure 3:
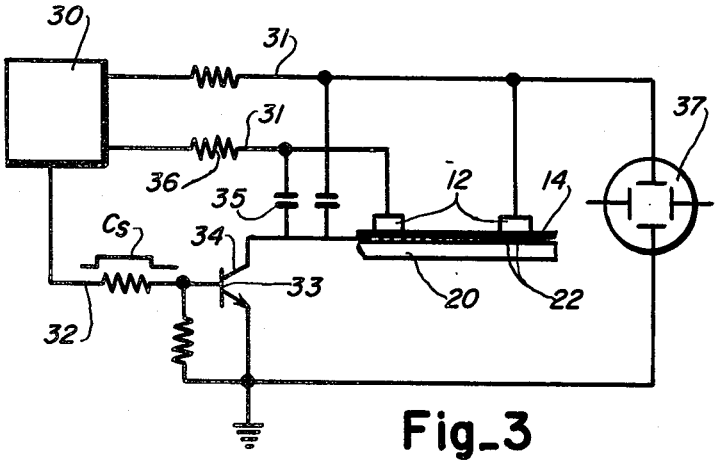
FIG. 3 is a schematic view of circuitry for selectively applying writing voltages over writing intervals to writing electrodes.
Figure 4:
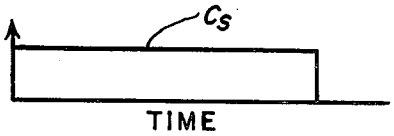
FIG. 4 is a waveform of a writing interval.

As shown in FIG. 3, the writing electrodes 12 are driven from a data source 30 which applies a marking voltage V on the order of 230 V on selected lines 31 according to the character desired. The data source 30 also issues a gating signal $C_s$ over line 32 which renders an NPN transistor 33 conductive over a time interval T (FIG. 4) on the order of 100 microseconds whereby the counterelectrode 22 which is connected to the collector 34 of the transistor 33 is grounded. As shown in FIG. 3, it is particularly advantageous to connect a capacitor 35 between each writing electrode and the counterelectrode and to select the values of the resistor 36 and capacitor 35 associated with each line 31 with relation to the electrical characteristics of the ribbon 14 and the size of the writing electrode 12 as will establish the voltage at which breakdown will occur. With an applied voltage on the order of 230 volts, the breakdown voltage is selected to be on the order of 10 volts.

The phenomenon of electrical breakdown, which leads to the destruction of the bridges of binder 26, can be proven with the aid of an oscillagraph comprising a cathode ray tube 37 with its vertical deflection plates connected across the writing and counterelectrodes. The oscillogram, produced over the time interval T for one of electrodes 12, is shown in FIG. 5. The multiple voltage breakdowns or spark overs constituting downwardly oriented peaks 38, as seen in the oscillogram, clearly indicate the points in time when the binder bridges 26 between the various suspended ink particles 25, shown in the right-hand side of FIG. 2, are being destroyed as illustrated in the left-hand side of FIG. 2. During spark overs, it is believed that the conductive pigment particles are propelled by the gases resulting from heat generated by the spark overs through the counterelectrode. It is believed, too, that the conductive particles may be propelled somewhat over part of the interval during which the electric field is increasing between discharges through the counterelectrode to the record material. Whatever the mechanism, all the binder and pigment below a writing electrode is transferred in the time interval T without damage to the nylon support 14. After the ink particles 25 have been driven out of the meshes 16 of the ink support 14, and through the perforations of transfer electrode 22, the full applied voltage V becomes reestablished.

For the purpose of printing characters, such as letters and numerals, it is expedient to combine a great number of electrodes 12 to form a matrix by assembling them in a common supporting head, such as one that is movably mounted opposite a carrier for recording material, such as paper 20, with the two-dimensional expanse of ink, suitably the impregnated mesh material 16 and the two-dimensional transfer electrode 22 therebetween. It is then possible, by means of a character generator, or data source, a known type of electronic circuit, to address, i.e. energize, selected electrodes 12 in a proper time sequence, so that desired characters are printed on the recording material in accordance with the above-described process.

The embodiments of the invention illustrated herein and described in detail are supplied by way of example, inasmuch as variations and modifications can easily be thought of within the scope of the invention.

What is claimed is:

1. A method of non-impact printing on record material, in which a ribbon of marking material comprising conductive ink particles suspended in a binder is utilized, said method comprising, placing said ribbon between a writing electrode and one surface of a permeable counterelectrode, urging said record material into contact with the other surface of said counterelectrode, and applying a voltage across said writing and counterelectrode sufficient over a given interval to cause said marking material to transfer through said permeable counterelectrode to said record material.

2. A method as recited in claim 1, wherein said binder is conductive and said applied voltage heats and softens said marking material.

3. A method as recited in claim 1, wherein said binder is insulating and said applied voltage effects multiple electrical breakdowns of said binder between conductive ink particles.

4. A non-impact printer comprising, a writing electrode, an open mesh counterelectrode, a ribbon having conductive ink particles suspended in an insulating binder located between said writing electrode and said counterelectrode, and means for applying a voltage across said writing electrode and said counterelectrode over a predetermined time interval sufficient to effect multiple electrical breakdowns between said ink particles to cause movement of said marking material through said counterelectrode to a record element in pressure contact with the surface of said counterelectrode opposite the surface in contact with said ribbon.

5. A non-impact printer as recited in claim 4, wherein said ribbon comprises woven nylon.

6. A non-impact printer as recited in claim 4, wherein said applied voltage is a multiple of the dielectric breakdown voltage.

7. A non-impact printer as recited in claim 4, including a capacitor connected across each writing electrode and said counterelectrode.

8. A method of non-impact printing on record material, in which a ribbon of marking material comprising conductive ink particles suspended in an insulating binder is utilized, said method comprising, placing said ribbon between a writing electrode and one surface of a permeable counterelectrode, urging said record material into contact with the other surface of said counterelectrode, and applying a voltage across said writing and counterelectrode sufficient over a given interval to effect multiple electrical breakdowns of the binder between conductive ink particles thereby to cause said marking material to transfer through said permeable counterelectrode to said record material.

* * * * *